US005262073A

United States Patent [19]

Schmitt et al.

[11] Patent Number: 5,262,073

[45] Date of Patent: Nov. 16, 1993

[54] LUBRICANT COMPOSITION

[75] Inventors: Robert H. Schmitt, Riverside, Conn.; Ronald J. Poole, Mullica Hill, N.J.

[73] Assignee: Mobil Oil Corporation, Fairfax, Va.

[21] Appl. No.: 928,675

[22] Filed: Aug. 12, 1992

Related U.S. Application Data

[63] Continuation of Ser. No. 471,659, Jan. 23, 1990, abandoned, which is a continuation of Ser. No. 331,066, Mar. 28, 1989, abandoned, which is a continuation of Ser. No. 846,476, Mar. 31, 1986, abandoned, which is a continuation of Ser. No. 395,758, Jul. 6, 1982, abandoned, which is a continuation of Ser. No. 103,982, Dec. 17, 1979, abandoned, which is a continuation-in-part of Ser. No. 938,140, Aug. 30, 1978, abandoned.

[51] Int. Cl.[5] ..... C09K 3/00

[52] U.S. Cl. ..... 252/33.2; 252/33.4; 252/74; 252/42.7; 252/67; 252/68; 252/389.52; 208/18

[58] Field of Search ..... 252/33.2, 33.4, 74, 252/42.7, 399.52, 33.6, 67, 68; 208/18

[56] References Cited

U.S. PATENT DOCUMENTS

| | | | |
|---|---|---|---|
| 2,816,867 | 12/1957 | Moore et al. | 252/33.4 |
| 2,954,344 | 9/1960 | Miller | 252/33.4 |
| 3,001,940 | 9/1961 | Watson et al. | 252/33.4 |
| 3,004,917 | 10/1961 | Fefer | 252/33.4 |
| 3,838,049 | 9/1974 | Souillard et al. | 252/32.5 |
| 3,920,562 | 11/1975 | Foehr | 252/33.4 |
| 4,328,111 | 5/1982 | Watson et al. | 252/33.4 |

OTHER PUBLICATIONS

H. H. Zuidema, The Performance of Lubricating Oils, pp. 46–47 1984 Annual Book of ASTM Standards, vol. 05.01 Petroleum Products and Lubricants.

*Primary Examiner*—Helane Myers

*Attorney, Agent, or Firm*—Alexander J. McKillop; George W. Hager, Jr.; Michael J. Mlotkowski

[57] ABSTRACT

Non-emulsive lubricant compositions are provided when an additive mixture of a metal-alkylaromatic sulfonate and an alkaline-earth metal alkyl phenate are added in minor effective amounts to lubricant compositions.

20 Claims, No Drawings

LUBRICANT COMPOSITION

This application is a continuation of Ser. No. 07/471,659, filed Jan. 23, 1990, now abandoned which is a continuation of Ser. No. 07/331,066 filed Mar. 28, 1989, now abandoned which is a continuation of Ser. No. 06/846,476 filed Mar. 31, 1986, which is now abandoned which is a continuation of Ser. No. 06/395,758 filed Jul. 6, 1982 which is now abnaondoned which is a continuation of Ser. No. 06/103,982 filed Dec. 17, 1979, which is now abandoned which is a continuation-in-part of Ser. No. 05/938,140 filed Aug. 30, 1978, which is now abandoned.

BACKGROUND OF THE INVENTION

1. Field of the Invention

This application is directed to lubricating compositions having improved demulsibility. This improvement is accomplished by incorporating therein a minor amount of a novel additive combination consisting of a metal-alkylaromatic synthetic sulfonate and an alkaline-earth metal alkyl phenate. This application in a more particular aspect is directed to hydraulic fluids incorporating a minor amount of said additive combination and thereby having improved demulsibility.

2. Description of the Prior Art

Modern lubricating oils and hydraulic oils require a number of features such as antiwear, anticorrosion, deposit resistance, and water separation ability. Zinc dithiophosphates can be used to provide good antiwear properties. Metal salts such as calcium sulfonates and calcium phenates can be used for rust/corrosion protection and for mild dispersant activity to reduce deposit formation. Stronger dispersants such as succinimides can be used to further enhance deposit-free protection.

U.S. Pat. No. 3,004,917 discloses the additive combination of metal sulfonates and metal salts broadly and U.S. Pat. No. 2,954,344 discloses a combination of hydrocarbon sulfonates and alkaline-earth metal alkyl phenates. It has been found that combinations of the above-described materials perform their expected functions but are generally emulsive and do not permit separation of contaminant water. Good water separation is needed to facilitate water removal in for example critical hydraulic field service such as machine tools where gross water contamination can adversely affect machining performance. However, the specific combination herein embodied in the specific ratios disclosed below have been found to accomplish the above functions and also unexpectedly provide good water separation.

SUMMARY OF THE INVENTION

The compositions of this invention comprise oils of lubricating viscosity and hydrocracked oils, mineral or synthetic and various hydrocarbon functional fluids such as hydraulic oils, transmission fluids, automotive oils, gear oils and waxes or greases prepared from said oils of lubricating viscosity, and a minor amount of a metal-alkyl aromatic synthetic sulfonate and an alkaline-earth metal alkyl phenate. Accordingly, the compositions of this invention comprise said lubricant media and said additive combination of sulfonate and phenate in an amount effective to demulsify the base media.

DESCRIPTION OF SPECIFIC EMBODIMENTS

A Group II metal-alkylaromatic or alkaryl synthetic sulfonate, in combination with an alkaline-earth metal alkyl phenate to effect good water separation in the presence of other dispersant additives. The demulsibility effect of this sulfonate/phenate combination is superior to either of these two components alone and is sufficient to overcome the poor demulsibility of strong dispersants and/or base stock. However, this sulfonate must be synthetically made from an alkyl or dialkyl aromatic instead of alkylated benzene (synthetic) or selected petroleum fractions (natural). A typical composition is characterized by the following chemical designation:

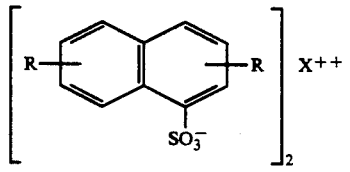

where R is alkyl having from 1 to about 20 carbon atoms and X is a Group I and II metal. Group I and II metals found particularly useful include lithium, sodium, calcium and zinc. Suitable alkaline-earth metals include barium and calcium. The synthetic naphthalene sulfonates are conveniently available through normal commercial sources. This is also true with respect to the alkaline-earth metal alkyl phenate. One highly useful commercial phenate is conveniently prepared from propylene tetramer. Although the alkyl phenate may be prepared from, for example, a polyolefin no carbon to carbon unsaturation exists in the alkyl phenate itself. Alkyl groups having from 2 to 100 carbon atoms are preferred. The unique demulsibility performance of this novel combination is demonstrated below with a strong commercial dispersant.

As stated hereinabove, the novel demulsifier additive combination of this invention may be used in mineral and synthetic base stock and may be incorporated in any lubricating media. This can include oils of lubricating viscosity and also greases in which any of the aforementioned oils are employed as vehicles and functional fluids such as hydraulic oils. In general, synthetic oils alone or in combination with mineral oils, or as grease vehicles can be effectively rendered nonemulsive thereby. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl)adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted di-phenyl ethers typified by a butyl-substituted bis-(p-phenoxy phenyl) ether, phenoxy phenylether, etc.

The concentrations and ratios of the metal-alkyl-aromatic synthetic sulfonate to alkaline-earth metal alkyl phenate are highly critical for successful demulsibility performance. The preferred concentrations are one part of sulfonate to one part of phenate. In compositions requiring a dispersant, it is preferable to use one part each of sulfonate and phenate to three parts dispersant. Accordingly effective concentration ranges are from 0.4% sulfonate/0.4 wt. % phenate to 0.75% sulfonate/0/75 wt. % phenate. Larger ratios or concentrations of sulfonate to phenate may be used, for example 0.75/0.25 and 0.9/0.1 are also highly effective combinations. However, mini-mixing the phenate component causes loss of other beneficial properties such as non-ferrous corrosion protection. The sulfonate concentration may vary conveniently from 0.3 to 1.0 wt. % and the phenate concentration may vary from 0.09 to 0.85 wt. %. All weight percentages are based on the total weight of the compositions. In other words the ratio of sulfonate to phenate can vary from 1:1 to 9:1 with the proviso that the ratio of sulfonate to phenate is at least 1:1 or more.

Various other additives may also be present in the composition in amounts from 0.001 to 10 wt. % based on the total weight of the final composition.

Water separation tests were carried out in accordance with ASTM Test Method D-1401 (time to separate 40 ml test oil from 40 ml water). The test data were recorded in the following tables. All test substances were obtained commercially,* including the calcium alkyl phenate and the calcium nonyl di-naphthalene synthetic sulfonate. Zinc alkyl dithiophosphate is an antiwear agent and zinc polybutyl succinimide is a well-known commercial dispersant. With respect to Table 1:

*The supplier of the phenate does not disclose the exact formulation.

From Examples 1–4 it is established that antiwear hydraulic oil containing a Zn commercial dispersant is very emulsive.

Examples 5–9 establish the fact that the phenates and sulfonates individually have poor water separation properties in mineral oil base stock.

Examples 10 and 11 establish that an alkaline-earth metal alkyl phenate and a metal-alkylaromatic synthetic sulfonate combined in accordance with the invention have unexpectedly good demulsibility and can be used to demulsify antiwear hydraulic oils containing a commercial zinc dispersant.

Examples 12–15 establish that synthetic naphthalene sulfonates of this invention combined with alkyl phenate will also demulsify dispersant antiwear hydraulic oil formulations. Sulfonates made from other synthetic sources or from natural petroleum results in heavy emulsification.

From Examples 16–119 it is established that the phenate/sulfonate mixture provides good demulsibility concentrations varying from about 0.4 to about 0.75 wt. % each. However other concentrations may be used, see examples 20–23.

TABLE 1

LUBRICANT COMPOSITIONS WITH DEMULSIFYING METAL SULFONATE/PHENATE

| Example No. | Commercial Antiwear Agent | Commercial Dispersant | Alkaline-Earth Metal Alkyl Phenate | Group II Metal Alkyl-aromatic Sulfonate (Synthetic) | Group II Metal Sulfonate from Olefins & Benzene (Synthetic) | Group II Metal Sulfonate from Petroleum Fractions (Natural) |
|---|---|---|---|---|---|---|
| 1 | — | — | — | — | — | — |
| 2 | 0.5 | — | — | — | — | — |
| 3 | — | 1.5 | — | — | — | — |
| 4 | 0.5 | 1.5 | — | — | — | — |
| 5 | — | — | 0.5 | — | — | — |
| 6 | — | — | — | 0.5 | — | — |
| 7 | — | — | — | — | 0.5 | — |
| 8 | — | — | — | — | — | 0.5 |
| 9 | — | — | — | — | — | — |
| 10 | — | — | 0.5 | 0.5 | — | — |
| 11 | 0.5 | 1.5 | 0.5 | 0.5 | — | — |
| 12 | 0.5 | 1.5 | 0.5 | 0.5 | — | — |
| 13 | 0.5 | 1.5 | 0.5 | — | 0.5 | — |
| 14 | 0.5 | 1.5 | 0.5 | — | — | 0.5 |
| 15 | 0.5 | 1.5 | 0.5 | — | — | — |
| 16 | 0.5 | 1.5 | 0.10 | 0.10 | — | — |
| 17 | 0.5 | 1.5 | 0.25 | 0.25 | — | — |
| 18 | 0.5 | 1.5 | 0.40 | 0.40 | — | — |
| 19 | 0.5 | 1.5 | 0.75 | 0.75 | — | — |
| 20 | 0.5 | 1.5 | 0.90 | 0.10 | — | — |
| 21 | 0.5 | 1.5 | 0.75 | 0.25 | — | — |
| 22 | 0.5 | 1.5 | 0.25 | 0.75 | — | — |
| 23 | 0.5 | 1.5 | 0.10 | 0.90 | — | — |
| 24 | — | — | — | — | — | — |
| 25 | 0.5 | — | — | — | — | — |
| 26 | — | 1.5 | — | — | — | — |
| 27 | 0.5 | 1.5 | — | — | — | — |
| 28 | — | — | 0.5 | — | — | — |
| 29 | — | — | — | 0.5 | — | — |
| 30 | — | — | 0.5 | 0.5 | — | — |
| 31 | 0.5 | 1.5 | 0.5 | 0.5 | — | — |

| Example No. | Group II Metal Sulfonate from $C_{16}$–$C_{20}$ Olefin (Cracked Wax) and Benzene (Synthetic) | % 150 SUS at 100° F. Mineral Oil | % 150 SUS at 100° F. SHF + Ester | Water & Oil Separation Test D1401 at 130° F. Minutes to 0 ml Emulsion(1) |
|---|---|---|---|---|
| 1 | — | 100.0 | — | 60 (29 ml) |
| 2 | — | 99.5 | — | 60 (16 ml) |
| 3 | — | 98.5 | — | 60 (80 ml) |
| 4 | — | 98.0 | — | 60 (80 ml) |
| 5 | — | 99.5 | — | 60 (16 ml) |
| 6 | — | 99.5 | — | 60 (4 ml) |
| 7 | — | 99.5 | — | 60 (29 ml) |

TABLE 1-continued

| | | | | |
|---|---|---|---|---|
| 8 | — | 99.5 | — | 60 (80 ml) |
| 9 | 0.5 | 99.5 | — | 60 (66 ml) |
| 10 | — | 99.0 | — | 15 |
| 11 | — | 97.0 | — | 18 |
| 12 | — | 97.0 | — | 18 |
| 13 | — | 97.0 | — | 60 (80 ml) |
| 14 | — | 97.0 | — | 60 (80 ml) |
| 15 | 0.5 | 97.0 | — | 60 (80 ml) |
| 16 | — | 97.80 | — | 60 (80 ml) |
| 17 | — | 97.50 | — | 60 (80 ml) |
| 18 | — | 97.20 | — | 8 |
| 19 | — | 96.50 | — | 8 |
| 20 | — | 97.00 | — | 60 (80 ml) |
| 21 | — | 97.00 | — | 60 (80 ml) |
| 22 | — | 97.00 | — | 15 |
| 23 | — | 97.00 | — | 25 |
| 24 | — | — | 100.0 | 10 |
| 25 | — | — | 99.5 | 5 |
| 26 | — | — | 98.5 | 60 (80 ml) |
| 27 | — | — | 98.0 | 60 (80 ml) |
| 28 | — | — | 99.5 | 60 (42 ml) |
| 29 | — | — | 99.5 | 25 |
| 30 | — | — | 99.0 | 7 |
| 31 | — | — | 97.0 | 15 |

(1)Figures in parentheses show actual ml of emulsion remaining at the end of the 60-minute test.

TABLE 2

LUBRICANT COMPOSITIONS WITH DEMULSIFYING METAL SULFONATE/PHENATE

| Example No. | Repeatability of D1401 in minutes |
|---|---|
| 1 | ±5 |
| 2 | ↑ |
| 3 | ↑ |
| 4 | ↑ |
| 5 | ↑ |
| 6 | ↓ |
| 7 | ↓ |
| 8 | ↓ |
| 9 | ↓ |
| 10 | ±3.5 |
| 11 | ±3.5 |
| 12 | ±3.5 |
| 13 | ±5 |
| 14 | ±5 |
| 15 | ±5 |
| 16 | ±5 |
| 17 | ±5 |
| 18 | ±2.5 |
| 19 | ±2.5 |
| 20 | ±5 |
| 21 | ±5 |
| 22 | ±3.5 |
| 23 | ±4 |
| 24 | ±3 |
| 25 | ±1.5 |
| 26 | ±5 |
| 27 | ±5 |
| 28 | ±5 |
| 29 | ±4 |
| 30 | ±2.5 |
| 31 | ±3.5 |

Examples 20–23 establish that relative proportions of 2 parts phenate to 1 part sulfonate is ineffective, and 2 parts sulfonate to 1 part phenate produces good results. Further increase of sulfonate with reduction of phenate does not give further improvement in demulsibility and causes loss of other beneficial performance properties provided by the phenate.

From Examples 24–31 it is established that the same demulsifying effect is observed in SHF/ester base fluid. Although the base fluid has good initial demulsibility and the sulfonate alone does also, the phenate/sulfonate mixture shows unexpectedly improved demulsibility and will demulsify the ZnDTP/dispersant combination.

The repeatability data in Table 2 corroborates the findings of Table 1.

Although preferred embodiments have been exemplified, it is understood by all those of skill in the art that variations and departures within the scope of this disclosure may be readily made.

We claim:

1. A lubricant composition of improved demulsibility comprising an oil of lubricating viscosity, a zinc dispersant and a demulsifying amount of an additive mixture comprising a calcium nonyl di-naphthalene synthetic sulfonate, and a calcium alkylphenate containing 2 to 100 carbon atoms, the concentration of sulfonate varying from 0.3 to 1.0 weight percent and the concentration of phenate varying from 0.09 to 0.85 weight percent; wherein said lubricant composition is capable of completely separating from water in less than 60 minutes in ASTM Test Method D-1401 and in the absence of said additive mixture said oil containing said zinc dispersant is emulsive.

2. The composition of claim 1 wherein the concentration of sulfonate varies from 0.4 to 0.9 wt. % and the concentration of the phenates varies from 0.1 to 0.75 wt. %.

3. The composition of claim 1 wherein the ratio of sulfonate to phenate varies from 1:1 to 9:1 with the proviso that the ratio of sulfonate to phenate is at least 1:1 or more.

4. The composition of claim 3 wherein the ratio of sulfonate to phenate is 1 to 1.

5. The composition of claim 1 wherein the alkyl phenate has from 2 to about 30 carbon atoms.

6. The composition of claim 1 wherein the oil is a mineral base oil.

7. The composition of claim 1 wherein the oil is a synthetic base oil.

8. The composition of claim 1 wherein said fluid also contains an antiwear agent.

9. The composition of claim 8 wherein the concentration of sulfonate is 0.75 wt. % and the concentration of phenate is 0.75 wt. %.

10. The composition of claim 1 wherein the alkyl group of the alkylphenate is derived from a polyolefin.

11. The composition of claim 1 in which said zinc dispersant is a zinc polybutyl succinimide.

12. The composition of claim 1 which contains, in addition, a zinc dialkylthiophosphate anti-wear agent.

13. The composition of claim 1 which contains, in addition, a zinc dialkylthiophosphate anti-wear agent.

14. A method of formulating a lubricant composition, comprising the steps of:

(a) forming a demulsifying additive material by mixing a calcium nonyl di-naphthalene synthetic sulfonate, and a calcium alklyphenate containing 2 to 100 carbon atoms, the concentration of sulfonate varying from 0.3 to 1.0 weight percent and the concentration of phenate varying from 0.09 to 0.85 weight percent; and (b) adding a demulsifying amount of the additive material formed in step (a) to an emulsive lubricant composition comprising an oil of lubricating viscosity and a zinc dispersant;

wherein the resultant mixture is capable of completely separating from water in less than 60 minutes in ASTM Test Method D-1401.

15. The method of claim 14, wherein the ratio of sulfonate to phenate varies from 1:1 to 9:1 with the proviso that the ratio of sulfonate to phenate is at least 1:1 or more.

16. The method of claim 15, wherein the ratio of sulfonate to phenate is 1 to 1.

17. A hydraulic fluid of improved demulsibility comprising an oil of lubricating viscosity, a zinc dispersant and a demulsifying amount of an additive mixture comprising a calcium nonyl di-naphthalene synthetic sulfonate, and a calcium alkylphenate containing 2 to 100 carbon atoms; wherein said hydraulic fluid is capable of completely separating from water in less than 60 minutes in ASTM Test Method D-1401 and in the absence of said additive mixture said oil containing said zinc dispersant is emulsive.

18. The hydraulic fluid of claim 17 wherein said zinc dispersant is a zinc polybutyl succinimide.

19. A method of formulating a hydraulic fluid, comprising the steps of:

(a) forming a demulsifying additive material by mixing a calcium nonyl di-naphthalene synthetic sulfonate, and a calcium alkylphenate containing 2 to 100 carbon atoms, the concentration of sulfonate varying from 0.3 to 1.0 weight percent and the concentration of phenate varying from 0.09 to 0.85 weight percent; and (b) adding a demulsifying amount of the additive material formed in step (a) to an emulsive hydraulic fluid comprising an oil of lubricating viscosity and a zinc dispersant;

wherein the resultant mixture is capable of completely separating from water in less than 60 minutes in ASTM Test Method D-1401.

20. The method of claim 19 wherein the zinc dispersant is a zinc polybutyl succinimide.

* * * * *